US005244584A

United States Patent [19]

Schlieperskoetter

[11] Patent Number: 5,244,584

[45] Date of Patent: Sep. 14, 1993

[54] CENTRIFUGE WITH WEAR RESISTANT OUTLET OPENINGS

[75] Inventor: Bernd Schlieperskoetter, Neukirchen-Seelscheid, Fed. Rep. of Germany

[73] Assignee: Kloeckner-Humboldt-Deutz AG, Fed. Rep. of Germany

[21] Appl. No.: 839,956

[22] Filed: Feb. 21, 1992

[30] Foreign Application Priority Data

Feb. 21, 1991 [DE] Fed. Rep. of Germany ..... 4105412

[51] Int. Cl.[5] ..... B04B 1/00

[52] U.S. Cl. ..... 210/787; 210/781; 210/512.1; 210/374; 366/320; 494/52; 494/53; 494/55; 494/56; 209/144; 209/211

[58] Field of Search ..... 210/781, 360.1, 369, 210/374, 394, 512.1; 366/318, 320; 494/52, 53, 55, 56; 209/114, 211

[56] References Cited

U.S. PATENT DOCUMENTS 3,764,062 10/1973 Brautigam ..... 494/54

4,539,105 9/1985 Metcalf ..... 209/211

4,793,925 12/1988 Duvall et al. ..... 210/512.1

FOREIGN PATENT DOCUMENTS 2729057 1/1979 Fed. Rep. of Germany .

*Primary Examiner*—Robert A. Dawson

*Assistant Examiner*—David Reifsnyder

*Attorney, Agent, or Firm*—Hill, Steadman & Simpson

[57] ABSTRACT

A method and apparatus for the separation of a slurry into a light fraction and a heavier fraction with a rotatable drum separator having a rotatable worm therein driven independently of the drum with an inlet for the slurry into the drum, an outlet for a liquid fraction, and outlet openings adjacent one end of the drum such as in the conical portion for the removal of the heavier abrasive sludge fraction with the openings extending at an angle opposite the direction of rotation of the drum and having wear-resistant inserts in the opening attached to webs beside the openings and removable by being pivoted out through the openings.

16 Claims, 3 Drawing Sheets

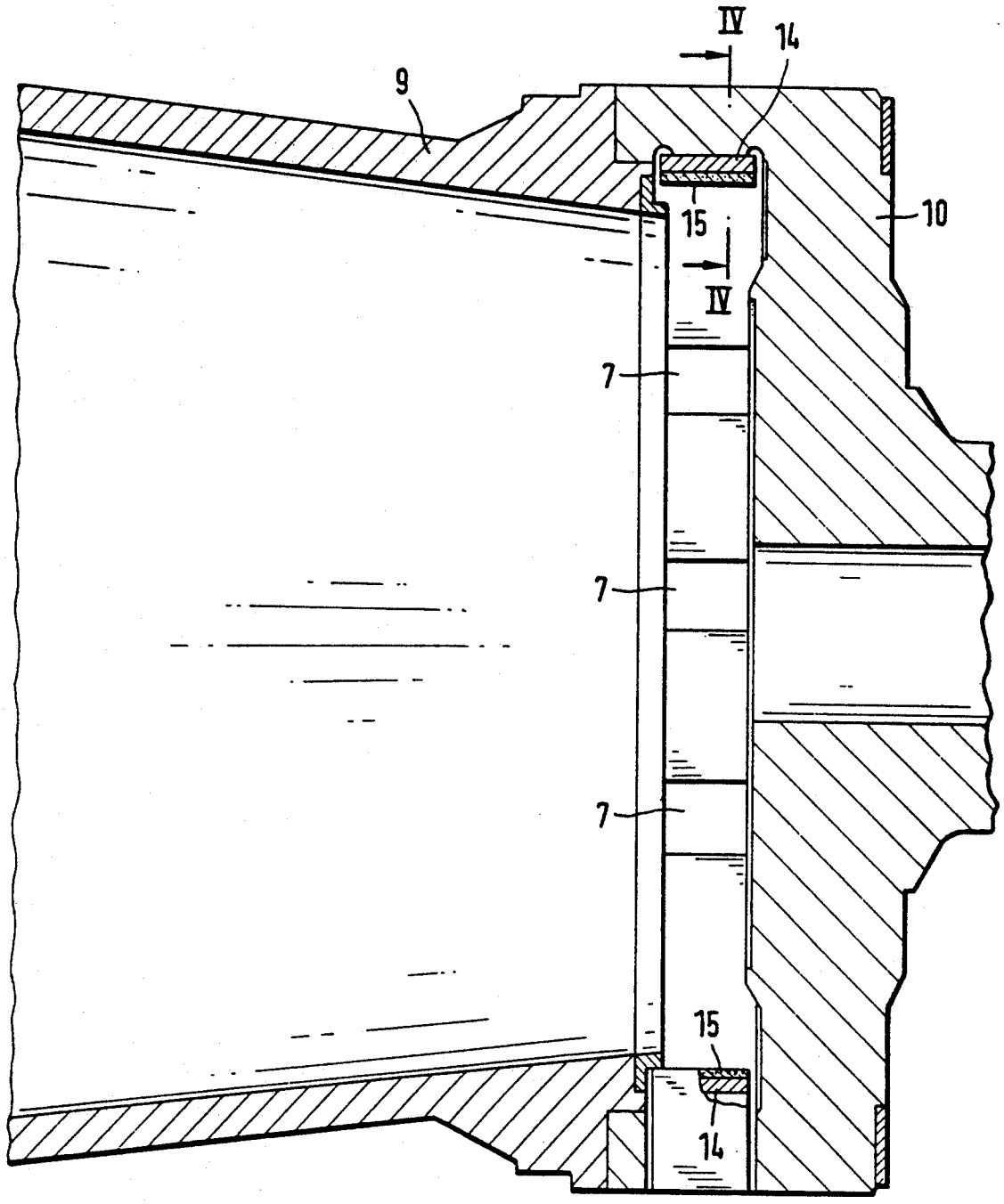
FIG.3
FIG. 5
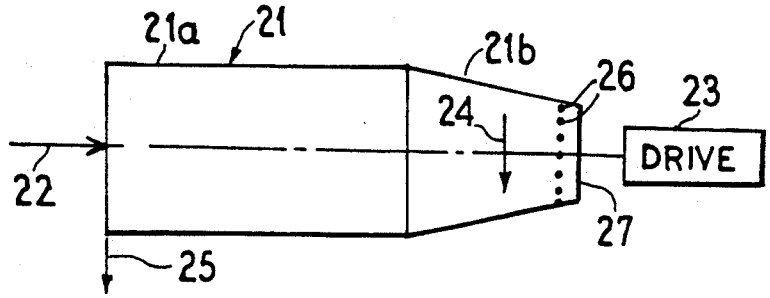

CENTRIFUGE WITH WEAR RESISTANT OUTLET OPENINGS

BACKGROUND OF THE INVENTION

The invention relates to improvements in centrifugal separators and to an improved method of separating and an improved centrifuge of the type having a solid bowl driven in rotation with a worm therein driven independently of the bowl.

More particularly, the invention relates to an improved arrangement for the discharge of the solid fraction from the centrifuge in the manner in which the discharge is constructed.

German Letters Patent 27 29 057 discloses a solid bowl worm centrifuge for separating solids and liquid mixtures. The centrifuge has an outer shell or drum with a main cylindrical body portion and a conical end. The slurry is admitted through an opening into the drum and the liquid fraction is discharged at a first end, and openings are provided at a second end at the end of the conical portion of the shell for the discharge of the solids or sludge fraction. The walls of the opening extend either generally axially or can extend radially. Either radial or axial openings are used in approximately right angle or rectangular sharp deflection of the solids in the sludge fraction as the sludge fraction exits through the opening. This is particularly abrupt and vigorous because of the rotation of the drum and the necessity of the solids changing their path of action from a movement in one direction to a sharp radial movement. The movement is made more abrupt because of the centrifugal discharge caused as the drum is rotating.

As practice has shown, this abrupt and substantial deflection of the solids in the region of the solids discharge opening leads to rapid and high wear of the walls of the openings this is particularly true when substantial quantities of abrasive material are present, such as silica sands and the like which are often present in the solids so that the centrifuge must be frequently brought to a halt and laid up while repair is carried out. This involves a substantial disadvantage and a considerable outlay for work, time and cost of repair of the openings as well as the cost in shut down of the operation of the separator. Some centrifuges have been employed wherein the solids discharge occurs through nozzles arranged in the basket shell and the walls of these nozzles are also arranged to extend radially toward the outside and are affected by the same disadvantages.

Accordingly, an object of the present invention is to provide a method and apparatus which greatly reduces the wear at the walls of the solids discharge opening in a rotary centrifugal separator.

A further object of the invention is to provide an improved rotary centrifugal separator structure wherein openings for the sludge fraction are provided which are not subjected to rapid wear and wherein if wear occurs, the openings can be rapidly and easily repaired and replaced.

A still further object of the invention is to provide an improved centrifugal separator with a sludge discharge opening arrangement wherein the openings are uniquely structured and provided with wear inserts which are particularly constructed for sustaining wear and when wear occurs, for quick and rapid removal and replacement.

A further object of the invention is to provide exit openings for sludge from a rotary centrifugal separator wherein openings are so constructed to minimize wear and linings are provided for the opening which is situated so that wear is minimized.

FEATURES OF THE INVENTION

In accordance with the invention, a centrifugal separator is provided with a cylindrical shell portion and a conical end portion and sludge exit openings adjacent an end wall in the conical portion which are situated to extend obliquely in a direction opposite the rotational direction of the drum. The arrangement provides for the discharge of abrasive sludge so that a minimal deflection of the solids occurs during operation of the centrifuge so that as a result, the wear at the walls of the discharge opening is considerably reduced in comparison to previously known discharge openings. The arrangement is such that the frequency of repair is greatly reduced and repair costs can be eliminated or substantially reduced. The wear at the walls of the solids discharge opening is such that it is essentially uniform on all sides during the course of longer operation of the centrifuge which is advantageous for potential repair jobs for the solids discharge openings.

In order to protect the walls of the solids discharge opening at the centrifuge drum, the openings are lined with a highly wear-resistant material which is of unique construction and uniquely situated so as to encounter minimum wear having wall portions situated to resist wear in addition to the fact that the openings are angularly situated relative to the direction of rotation of the drum.

In accordance with a further development of the invention, the openings are formed by highly wear-resistant elements which have an angular cross-section so that they can be detachably arranged at a distance between the end of the centrifugal drum and are uniformly distributed over the circumference. The walls of the element forming the openings form obliquely outwardly directed channels so that the channels extend opposite the direction of rotation of the drum. The detachable arrangement of highly wear-resistant elements is such that the walls of the elements have an angular cross-section to form the obliquely outwardly directed channels and the elements ca easily be built in between the end of the centrifuge drum and can in turn, be very quickly replaced proceeding from the outside of the drum when they are worn and need replacement.

The angular element inserts are detachably supported on webs that are firmly joined at the end wall of the centrifugal drum. The webs are critically spaced a distance from one another, which distance is greater than the pivoting radius of the element which is removed by a pivotal movement. In this way, every individual highly wear-resistant angular element can be removed proceeding from the outside of the drum by a simple turning and pivoting after being released from the web. Replacement of elements can be accomplished in the same manner.

For the detachable connection of the highly wear-resistant elements to the webs, suitable mechanical connector means may be provided such as bolts which can be turned from the outside of the drum for simple and quick access.

Other advantages, objects and features will become more apparent with the teaching of the principles of the invention in connection with the disclosure of the preferred embodiments thereof in the specification, claims and drawings, in which:

DESCRIPTION OF THE DRAWINGS

FIG. 3 is a sectional view taken through the conical section of a centrifuge with the auger omitted for clarity;

FIG. 5 is a schematic presentation of an overall view of a centrifugal separator with the other Figures showing details of the separator.

DESCRIPTION OF THE PREFERRED EMBODIMENT

Figure 1:
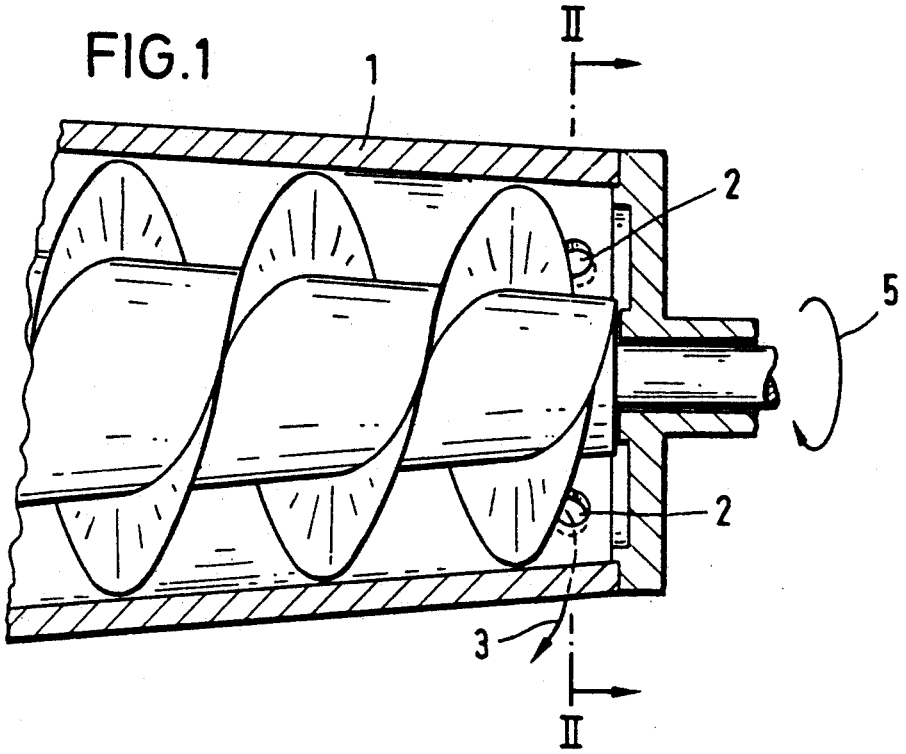
FIG. 1 is a sectional view taken through the axis of a conical end of the drum of a centrifugal separator.

FIG. 5 is a somewhat schematic showing of an overall centrifugal separator of the type to which the invention pertains. The separator includes a solid bowl or drum 21 having a cylindrical portion 21*a* and a conical portion 21*b*. In the separation process, a slurry is directed from a source to an inlet 22 into the separator and the separator has an auger therein driven independently of the separator drive with a drive 23 arranged to drive both the drum or shell in rotation in a first direction, indicated by the arrowed line 24, and to drive the auger contained within the drum independently of the drum.

A separation occurs within the centrifugal drum with a liquid fraction being discharged through an outlet at 25. Specially designed openings 26 are provided adjacent an end wall 27 of the drum, and these openings conduct the heavier sludge fraction from the separator. The openings and their specific construction will be described in further detail in FIGS. 1 through 4.

In FIG. 1, the cylindrical openings shown at 26 in FIG. 5, are illustrated at 2. These openings are uniformly distributed over the circumference of the conical portion 1 of the shell of the centrifuge.

The heavy sludge fraction with solids are discharged through these openings as indicated by the arrowed line 3 in FIG. 1.

Figure 2:
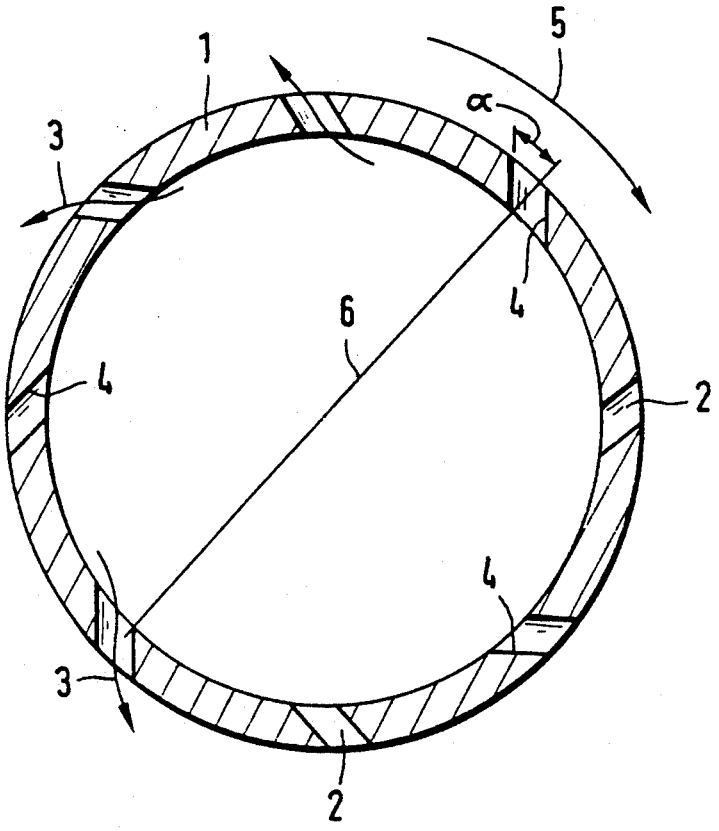
FIG. 2 is a sectional view taken substantially along line II—II of FIG. 1.

As FIG. 2 indicates, the walls of the cylindrical solids discharge openings 2 are arranged to extend obliquely or at an angle which is opposite the direction of rotation of the drum as indicated by the arrowed line 5. By this angular arrangement, a considerable reduction in the wear at the walls 4 of the solids discharge openings 2 is achieved since the solids indicated by the arrows 3 are only slightly deflected in flow direction and are discharged from the centrifugal drum through the openings 2.

In general, it is satisfactory in accordance with the principles of the invention when the obliquely outwardly proceeding wall of the solids discharge opening 2 is arranged such that the openings extend having an axis with an angle $\alpha$ of approximately 30° with a diametrical line 6 extending through the opening. The angle is preferably at 30° but a range of 5° to 55° would adopt some of the advantages of the invention.

Dependent on the consistency and viscosity of the solids to be discharged from the centrifugal drum, the walls 4 of the solids opening can also be arranged in the basket shell having a greater or lesser slope compared to the radial or diametrical line 6. In order, however, to protect the walls 4 of the solids discharge opening 2 against wear to an even further reaching extent, these openings can be advantageously lined with a highly wear-resistant material.

Figure 4:
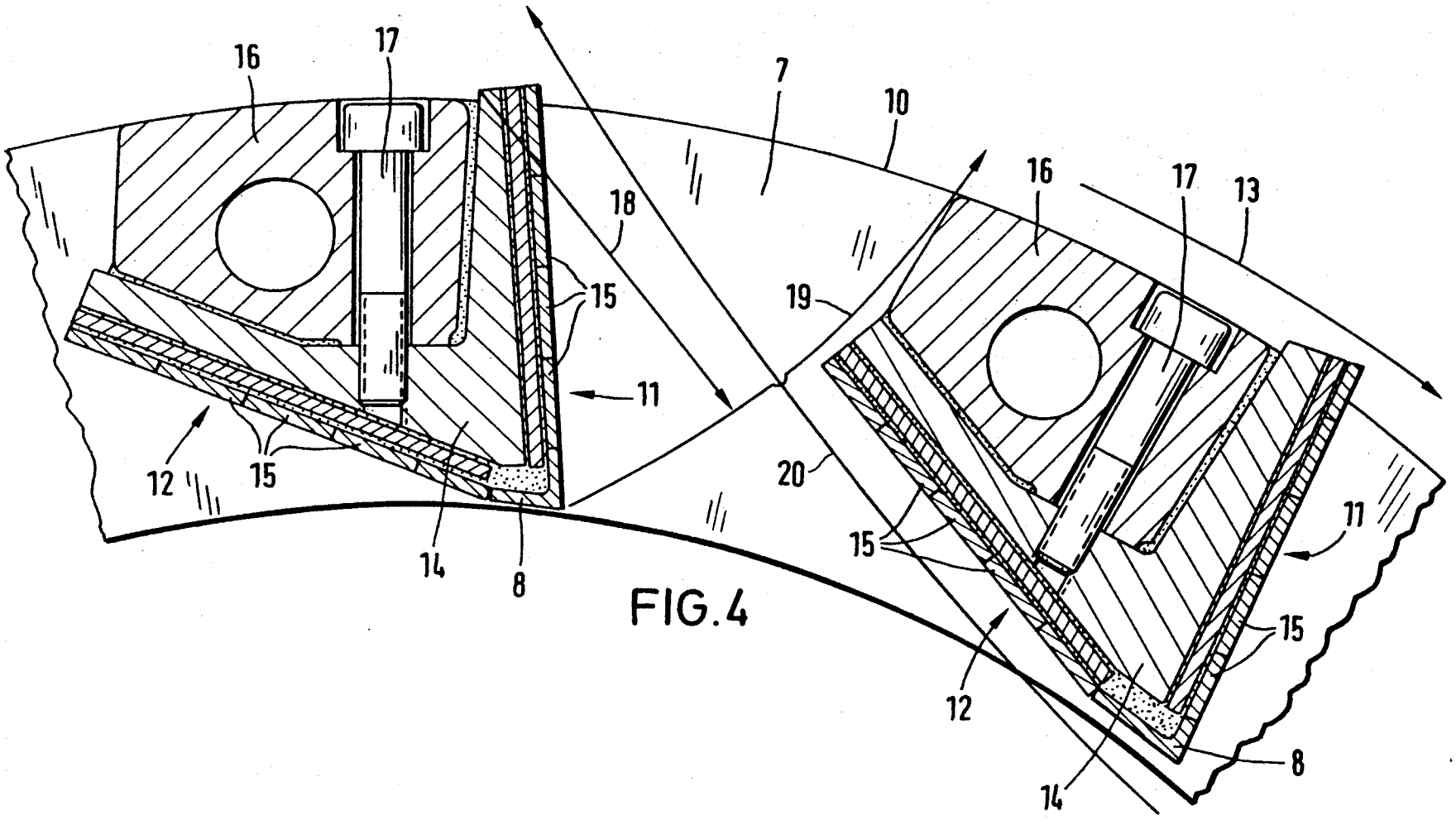
FIG. 4 is a sectional view taken along line IV—IV of FIG. 3 and shown in enlarged scale.

The centrifuge illustrated in more detail in FIG. 3 is also a solid bowl worm centrifuge for separating solids liquid mixtures. The drum portion 9 is the conical portion and the worm has been omitted for the sake of clarity of the drawing. As FIG. 4 illustrates, openings 7 for the solids discharge are formed by highly wear-resistant elements 8 having an angular cross-section that they ar detachably arranged in the end of the centrifugal drum inward from the end wall 10 and are uniformly distributed over the circumference.

The walls 11 and 12 of the wear resistant elements 8 forming the openings 7 are arranged directed obliquely outwardly and opposite the rotational direction 13 of the drum.

Channels having rectangular cross-sections are formed by the walls 11 and 12 lying respectively opposite one another in the elements 8 together with the end wall 10. With this regular cross-section, the primary wear effect of the abrasive materials in the sludge fraction exert their primary force in the circumferential direction, that is, against the surface of the walls 11 and 12. The ends of the rectangular openings do not encounter such severe abrasion.

The wear-resistant elements are basically L-shaped or angular in cross-section and are composed of a metallic base member 14 having hard metal or sintered ceramic plates 15 secured thereon. The elements 8 are fashioned with an angular cross-section and can be composed of a single metal member having a hard metal coat or the like. What is critical, however, is that this highly wear-resistant shape of the elements quite substantially lengthens the useful life of the elements so that they rarely have to be replaced.

If replacement becomes necessary, in order to be able to easily replace the wear-resistant elements shown in FIGS. 3 and 4, replacement can be accomplished from the outside of the drum. These elements are advantageously supported on webs 16 and are detachably connected to the webs such as by removable cap bolts 17. The webs 16 may be integral with the drum but are preferably welded to the removable end wall 10 of the centrifuge drum 9 and are thus firmly joined thereto. Webs 16 carrying the elements 8 are arranged at a spacing from one another that is greater than the pivoting radius 18 of the element. In this way, each of the elements 8, after the bolt 17 is removed, can be individually pivoted out in the direction of the arrow 19 with the operator withdrawing them from the outside and they can be replaced in the same manner by a new element. The assembly and disassembly of these highly wear-resistant elements 8 is thereby quite substantially simplified and facilitated since no assembly or disassembly work need be undertaken at the centrifuge.

As was particularly indicated by the arrow 20 in FIG. 4, a hardly noteworthy deflection of the solids occurs when they proceed into the solids discharge openings 7. As a result, wear at the walls 11 and 12 of the discharge openings 7 is not only considerably reduced but as a result, the repair costs connected therewith can be substantially eliminated.

The subject matter of the invention is not limited to the exemplary embodiment indicated in the Figures of the drawing. In addition to being employed in worm centrifuges, the subject matter can be utilized with some advantage in different types of centrifuges having only a cylindrical or only a conical shell. In addition to being executed with the assistance of removable cap bolts or releasable connection of the wear-resistance element, it can be produced by other known connectors. The metallic base member itself can be composed of highly wear-resistant material or provided with an additional coat to reduce wear such as by constructing the elements of built-up welding.

Thus, it will be seen there has been provided an improved separator which is capable of utilizing all of the advantages of the inherent design of a separator and effecting much longer wear without repair or attention. This obtains a saving in repair costs but also avoids shut down which can be costly in time consumption.

I claim as my invention:

1. A centrifugal separator of the type having a solid bowl with a rotatable worm therein comprising in combination:

a centrifuge drum mounted for rotation about an axis in a first rotary direction to receive slurry to be separated into a liquid fraction and a thicker sludge fraction;

and outlet openings leading from the drum each having an axis extending at a trailing direction relative to a diametrical line extending through the opening opposite said rotary direction of the drum for enhanced discharge of a heavier sludge fraction of the material being separated.

2. A centrifugal separator of the type having a solid bowl with a rotatable worm therein constructed in accordance with claim 1:

including a lining of highly wear-resistant material in said outlet openings for withstanding the wear of the passage of the sludge fraction.

3. A centrifugal separator of the type having a solid bowl with a rotatable worm therein constructed in accordance with claim 1:

including a highly wear-resistant element positioned in each of the openings;

means detachably securing said elements in said openings;

and said openings and elements uniformly spaced circumferentially over the circumference of the drum and forming openings having an axis extending opposite said rotary direction of the drum relative to diametrical lines passing through the openings.

4. A centrifugal separator of the type having a solid bowl with a rotatable worm therein constructed in accordance with claim 1:

including highly wear-resistant angular elements detachably secured in each of the openings;

webs between the opening firmly joined to an end wall of the centrifuge drum;

and attaching means between the webs and said elements.

5. A centrifugal separator of the type having a solid bowl with a rotatable worm therein constructed in accordance with claim 1:

including webs arranged beside the openings and spaced from each other at a predetermined space;

wear-resistant elements in each of the openings, said elements arranged to be rigidly supported and detachable by being pivoted from the openings;

said webs spaced from each other greater than the pivoting radius of the element to allow for removal and replacement of the elements.

6. A centrifugal separator of the type having a solid bowl with a rotatable worm therein constructed in accordance with claim 1:

including highly wear-resistant elements positioned in each of the openings;

and securing means providing a detachable connection for said elements for removal and replacement thereof.

7. A centrifugal separator of the type having a solid bowl with a rotatable worm therein constructed in accordance with claim 1:

including highly wear-resistant elements in each of the openings having a metallic base constructed of hard metal.

8. A centrifugal separator of the type having a solid bowl with a rotatable worm therein constructed in accordance with claim 1:

including highly wear-resistant elements in each of the openings constructed of a sintered ceramic plate.

9. A centrifugal separator of the type having a solid bowl with a rotatable worm therein constructed in accordance with claim 1:

wherein the openings are rectangular in shape and a wear-resistant material is provided at the circumferential lead and trailing edges of the opening.

10. A centrifuge separator of the type having a solid bowl with a rotatable worm therein comprising in combination:

a centrifuge drum having a conical end mounted for rotation about an axis:

means for driving the drum in a first rotary direction;

an auger therein driven at a rotational speed independent of the rotation of the drum;

an inlet opening for slurry to be delivered into the drum;

a first liquid fraction outlet leading from the drum;

sludge fraction outlet openings arranged circumferentially adjacent an end wall of the drum in said conical section, said outlet openings having an axis extending at a direction opposite the rotary direction of the drum and at a trailing direction relative to a diametrical line passing through the axis of the drum and through the opening;

and wear inserts in each of the openings removably secured to the drum for replacement.

11. A centrifuge separator of the type having a solid bowl with a rotatable worm therein constructed in accordance with claim 10:

wherein said sludge outlet openings have a first wear-resistant element mounted at one side of the openings and a second wear-resistant element mounted at an opposite side of the opening so that the openings are defined by said elements.

12. A centrifuge separator of the type having a solid bowl with a rotatable worm therein constructed in accordance with claim 11:

wherein said openings are rectangular in shape.

13. A centrifuge separator of the type having a solid bowl with a rotatable worm therein constructed in accordance with claim 12:

including webs between each of said openings;

and means on said webs for attaching each of said wear-resistant elements thereto.

14. A centrifuge separator of the type having a solid bowl with a rotatable worm therein constructed in accordance with claim 13:

wherein said wear-resistant elements are pivotally movable for removal from the opening and said webs are spaced circumferentially in an amount at least equal to the pivotal radius of the element being removed through the opening.

15. The method of separating slurry into a solid fraction and a liquid fraction comprising the steps:

passing the slurry into a centrifugal separator having an auger therein;

delivering a slurry to be separated into a liquid fraction and a thicker sludge fraction into the centrifuge driving the centrifuge in a first rotary direction for a separation effect;

and providing outlet openings adjacent one end in a circumferential wall of the separator having axes extending at an angle opposite the rotary direction for the drum relative to diametrical lines passing through the openings for discharge of the heavier sludge fraction of the material being separated.

16. The method of separating slurry into a solid fraction and a liquid fraction in accordance with the steps of claim 15:

including providing a removable wear-proof lining within each of the openings for resisting the abrasive result of the heavier fraction sludge.

* * * * *